US006508038B2

(12) United States Patent
Al-Ghitta

(10) Patent No.: US 6,508,038 B2
(45) Date of Patent: Jan. 21, 2003

(54) MODULAR TENON AND SLOT MORTISE BUILDING BLOCKS FOR HABITABLE SHELTERS

(76) Inventor: Ali Kashif Al-Ghitta, 1620 Worcester Rd. Apt. 330B, Framingham, MA (US) 01702

( * ) Notice: Subject to any disclaimer, the term of this patent is extended or adjusted under 35 U.S.C. 154(b) by 0 days.

(21) Appl. No.: 09/898,718

(22) Filed: Jul. 2, 2001

(65) Prior Publication Data

US 2002/0000071 A1 Jan. 3, 2002

Related U.S. Application Data

(60) Provisional application No. 60/216,151, filed on Jul. 3, 2000.

(51) Int. Cl.[7] ..... E04B 2/42

(52) U.S. Cl. ..... 52/505; 52/503; 52/592.6; 52/422; 52/421; 52/405.2; 405/286; 405/284; 446/125

(58) Field of Search ..... 52/422, 421, 592.6, 52/503, 505, 405.1, 405.2, 404.3, 404.4, 406.3, 406.1; 446/125, 124, 476, 85; 405/286, 284

(56) References Cited

U.S. PATENT DOCUMENTS

| | | | | | |
|---|---|---|---|---|---|
| 1,457,454 | A | * | 6/1923 | Patee | 52/421 |
| 1,664,867 | A | * | 4/1928 | Strand | 52/503 |
| 1,785,499 | A | * | 12/1930 | Sayers | 52/503 |
| 2,134,637 | A | * | 10/1938 | Ioucks | 52/505 |
| 2,902,853 | A | * | 9/1959 | Iofstrom | 52/503 |
| 3,224,155 | A | * | 12/1965 | Rook | 52/505 |
| 3,416,276 | A | * | 12/1968 | Caputo et al. | 52/422 |
| 3,782,049 | A | * | 1/1974 | Sachs | 52/309 |
| 3,788,020 | A | | 1/1974 | Gregori | |
| 3,905,170 | A | | 9/1975 | Heuttemann | |
| 4,033,082 | A | * | 7/1977 | Tashiro | 52/316 |
| 4,075,808 | A | | 2/1978 | Pearlman | |
| 4,258,522 | A | | 3/1981 | Amaral | |
| 5,024,035 | A | | 6/1991 | Hanson et al. | |
| 5,230,194 | A | | 7/1993 | McClure | |
| 5,379,565 | A | | 1/1995 | Vienne | |
| 5,421,135 | A | | 6/1995 | Stevens et al. | |
| 5,457,926 | A | | 10/1995 | Jensen | |
| 5,848,927 | A | * | 12/1998 | Frederiksen | 446/128 |
| 5,855,102 | A | * | 1/1999 | Chang | 52/604 |
| 5,901,520 | A | | 5/1999 | Abdul-Baki | |
| 5,992,102 | A | | 11/1999 | Ozawa | |
| 6,122,880 | A | | 9/2000 | Kolb et al. | |

FOREIGN PATENT DOCUMENTS

| | | | | |
|---|---|---|---|---|
| DE | 905060 | * | 7/1949 | 52/422 |
| DE | 2150874 | | 4/1973 | |
| EP | 0001360 | | 4/1979 | |
| FR | 25008956 | | 7/1981 | |
| GB | 176031 | * | 2/1922 | 52/422 |

* cited by examiner

*Primary Examiner*—Lanna Mai
*Assistant Examiner*—Phi Dieu Tran A

(57) ABSTRACT

Modular tenon and slot mortise building blocks include, for each building block: (a) hollow rectangular parallelepiped center block, (b) an outer siding member, (c) a first tenon member sandwiched between the center block and the siding member, (d) an inner facing member, and (e) a second tenon member sandwiched between the center block and the facing member. The tenon members are parallel and mounted to longitudinal sides of the center block. The tenon members are positioned and of a length so as to extend longitudinally of a first end of the center block by a first distance and so as to form mortised first and second recesses having a first depth behind the first and second tenon members, respectively, between the siding member and the center block and between the facing member and the center block. The first distance is substantially equal to the first depth.

8 Claims, 16 Drawing Sheets

102
110
108
106
104
110
106
104
108
104
106
108
110
108
104
106
102

MODULAR TENON AND SLOT MORTISE BUILDING BLOCKS FOR HABITABLE SHELTERS

CROSS REFERENCE TO RELATED APPLICATION

This application claims priority from United States Provisional Patent Application No. 60/216,151 filed Jul. 3, 2000 entitled Modular Tenon and Slot Mortise Building Blocks For Habitable Shelters.

FIELD OF THE INVENTION

This invention relates to the field of materials for constructing habitable shelters from a plurality of light weight, insulated and rigid interlocking modular components, and in particular, it relates to modular block components which may be interlocked using modified tenon and slot mortises and efficiently assembled in adjacent vertically offset arrays to form a habitable shelter having prefabricated siding.

BACKGROUND OF THE INVENTION

As a basis for satisfying the housing needs for the less fortunate in North America and in other countries, traditional residential construction based upon the current wood based methodology is impractical due to the cost of materials, the level of skill required of the labour force, and the length of time required to construct such residences. In addition such construction is impractical in remote locations and under many climate conditions.

Further, where the people in a locality have been deprived of their homes through the forces of a natural disaster or of political turmoil, or where exploration and development is undertaken in remote areas, shelters for use as dwellings, hospitals or storage areas are usually a priority. When such shelters are required, the lack of available construction time, materials or expertise at the scene renders on site construction by traditional methods impracticable.

Presently, portable shelters which are available for transportation to such a site have several shortcomings such as their cost, weight, their complex method of erection and assembly and that they generally provide only minimal protection from adverse temperatures, heavy rains or extreme environmental conditions.

In the prior art, applicant is aware of U.S. Pat. No. 6,065,265 which issued May 23, 2000 to Stenekes for a corner and end block for interlocking building block system. Stenekes' discloses an interlocking building block for mortarless walls. A block has integrally-formed projections which extend above the height of the block, and corresponding recesses formed in the lower surface of the block. The block has hollow vertical columns so that channels formed in opposed inner surfaces of the columns receive and locate corresponding projections of an underlying interlocking block. What is neither taught nor suggested, and which it is an object of the present invention to provide, is providing internal facing on one side of a modular block and external siding, the internal facing and the external siding offset in relation to interlocking members sandwiched between the block and the facing and siding respectively.

SUMMARY OF THE INVENTION

In summary, the modular tenon and slot mortise building blocks of the present invention for the modular construction of habitable shelters such as emergency shelters, greenhouses, low-cost housing, portable offices or bunkhouses for construction site, or other temporary buildings for human habitation, include, for each building block: (a) hollow rectangular parallelepiped center block, (b) an outer siding member, (c) a first tenon member sandwiched between the center block and the siding member, (d) an inner facing member, and (e) a second tenon member sandwiched between the center block and the facing member. The tenon members are parallel and mounted to longitudinal sides of the center block. The tenon members are positioned and of a length so as to extend longitudinally of a first end of the center block by a first distance and so as to form mortised first and second recesses having a first depth behind the first and second tenon members, respectively, between the siding member and the center block and between the facing member and the center block. The first distance is substantially equal to the first depth.

The tenon members are each, in lateral cross-section, chevron-shaped so as to form: (a) a ridge along the upper surface of the tenon members having a triangle-shape in lateral cross-section, and (b) a channel along the lower surface of the tenon members having the triangle-shaped in lateral cross-section. The siding member has a lower generally planar skirt which extends, cantilevered, gently flared downwardly from a base of the siding member mounted adjacent the first tenon member.

Advantageously a first plane containing a lowermost surface of the center block also contains a lowermost edge of the facing member, and a second plane, parallel to the first plane, containing an uppermost surface of the center block also contains uppermost edges of the facing member and the siding member.

In one embodiment the siding and facing members have oppositely disposed rectangular planar exposed surfaces.

In second and third embodiments the building block is radiussed around a corner so as to form corner blocks, wherein in the second embodiment the siding member is radially outermost relative to the corner and facing member radially innermost, and wherein in the third embodiment the facing member is radially outermost relative to the corner and the siding member is radially innermost, the second and third embodiments thereby forming outer and inner corner blocks respectively.

In one preferred embodiment the center block has frangible upper and lower walls whereby the frangible walls may be selectively broken through for passage of conduit through stacked rows, or through columns of the building blocks.

DETAILED DESCRIPTION OF EMBODIMENTS OF THE INVENTION

Figure 1:
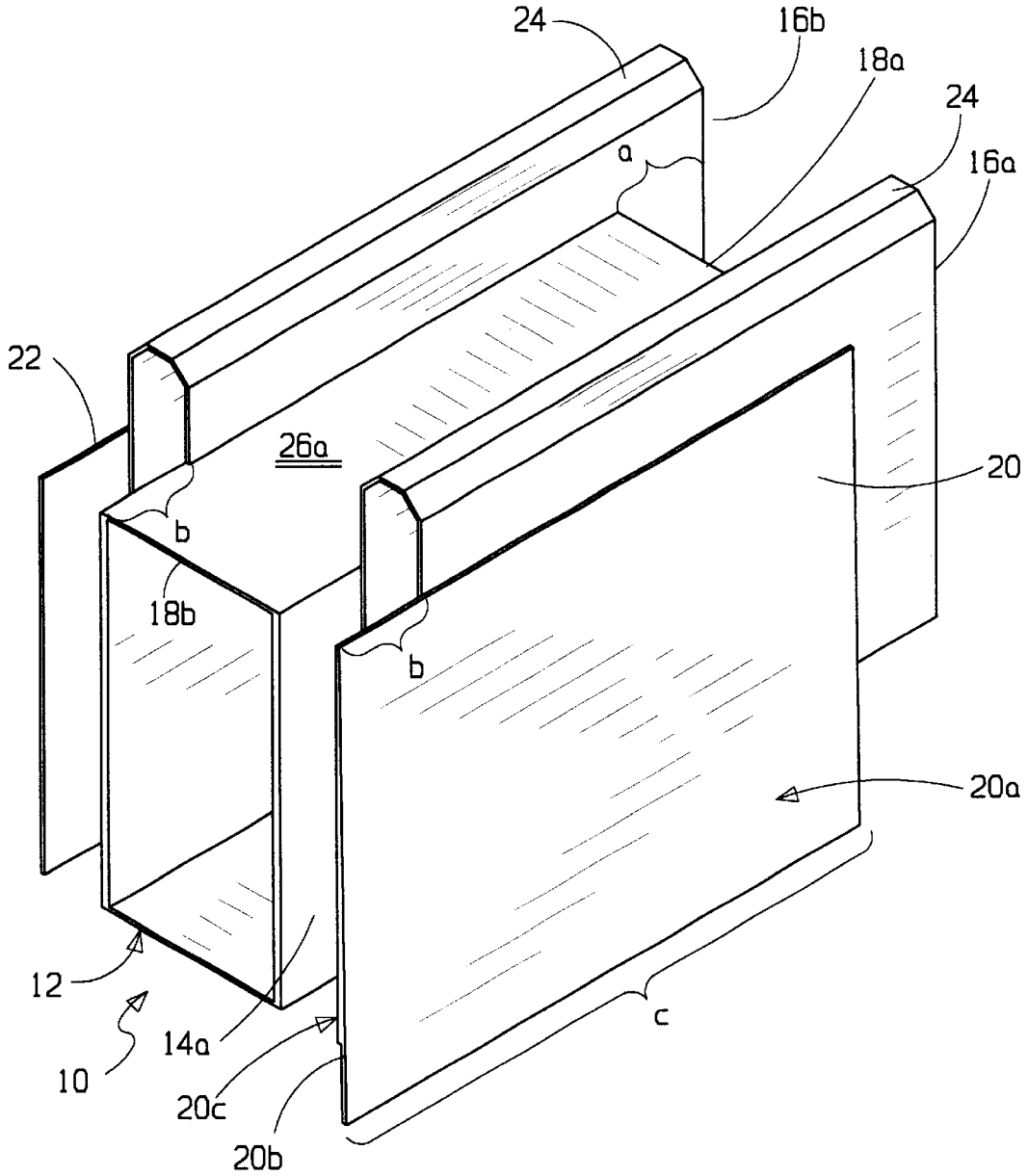
FIG. 1 is, in front perspective view, a wall building block of the present invention.
Figure 2:
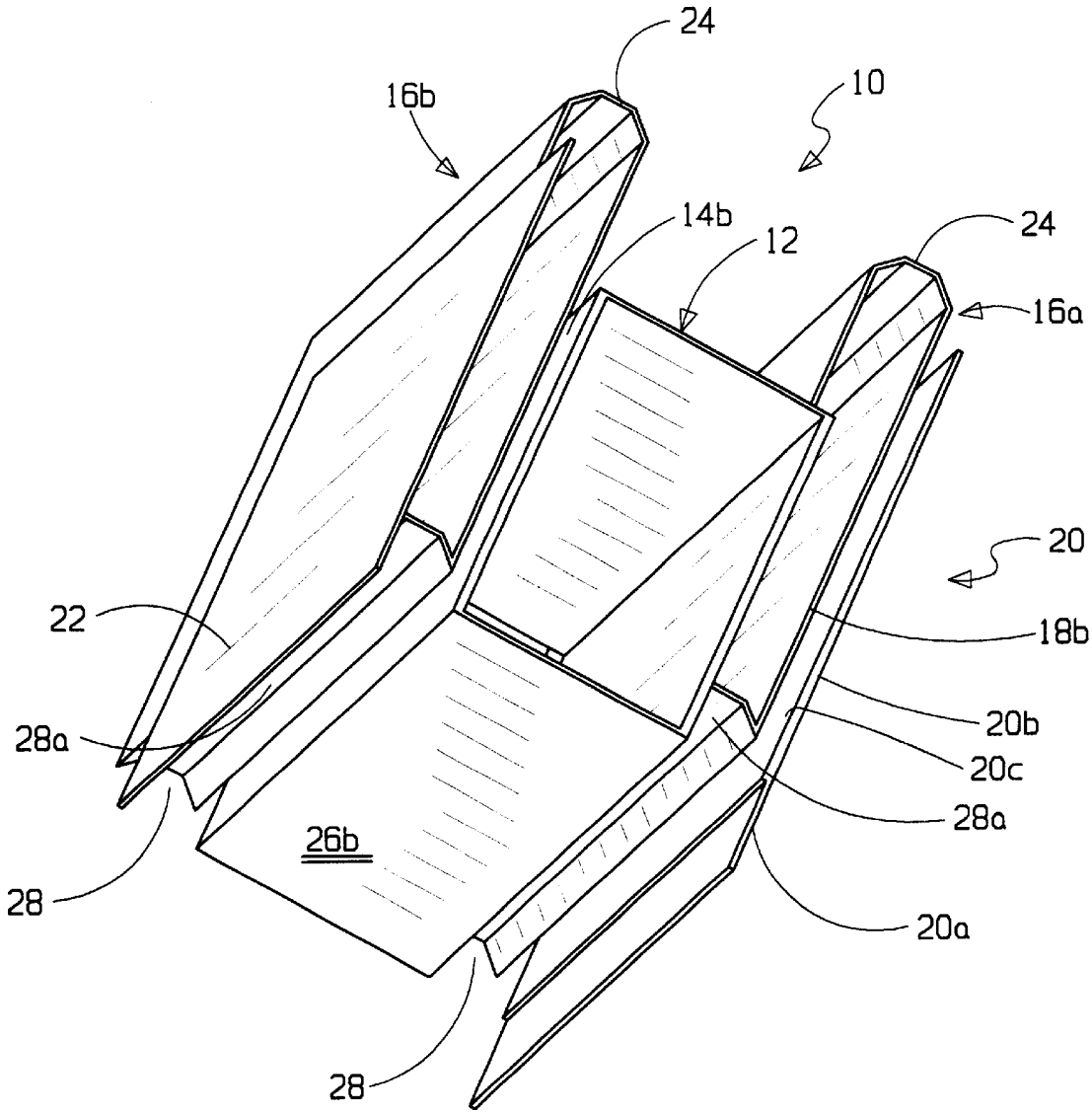
FIG. 2 is, in rear perspective view, the building block of FIG. 1.

As best seen in FIGS. 1 and 2, the tenon and slot mortise building block 10 of the present invention has a central hollow center block 12 which is shaped as a rectangular parallelepiped. Opposite longitudinal sides 14*a* and 14*b* of the center block define rigid mounting surfaces to which are mounted rigid elongate tenon members 16*a* and 16*b* respectively. The tenon members are offset longitudinally relative to block 12 so as to project longitudinally from end 18*a* of block 12, preferably by the same distance for each tenon member. Tenon member 16*a* and tenon member 16*b* are each offset so as to project from end 18*a* by a distance "a". Similarly, the opposite ends of tenon members 16*a* and 16*b* are recessed relative to end 18*b* of block 12 by a distance "b" so as to form slot mortises corresponding in size to the tenon projections.

Rigid siding member 20 is mounted onto tenon member 16*a* in oppositely disposed relation to block 12 so as to sandwich tenon member 16*a* therebetween. Siding member 20 in the preferred embodiment has a longitudinal length "c", which is the same as the longitudinal length of block 12. Siding member 20 is aligned laterally relative to block 12 so that end surfaces of the siding member are coplanar with the ends of the block 12. Thus for example, end surface 20*b* of siding member 20 is coplanar with end 18*b* of block 12. Thus tenon member 16*a* projects longitudinally by the same distance relative to block 12 as siding member 20. At its opposite end, tenon member 16*a* forms a mortised recess having a depth "b" relative to both block 12 and siding member 20. The longitudinal projection of tenon member 16*a* functions as a tenon which interlocks with a corresponding recess, which acts as a slot mortise, in the next adjacent building block in a horizontal array of such blocks.

Similarly, tenon member 16*b* is sandwiched between block 12 and internal facing member 22. The longitudinal projection of tenon member 16*b* by distance "a" forms a tenon which mates into a corresponding recess, which acts as a second slot mortise, in the next adjacent building block 10. The recess has a depth "b" formed by the offset of tenon member 16*b* relative to both block 12 and facing member 22. Advantageously, dimension "a" and dimension "b" are equal so that the projecting ends of tenon members 16*a* and 16*b* snugly mate against the recessed ends of corresponding tenon members 16*a* and 16*b* in a next adjacent building block 10.

Figure 3:
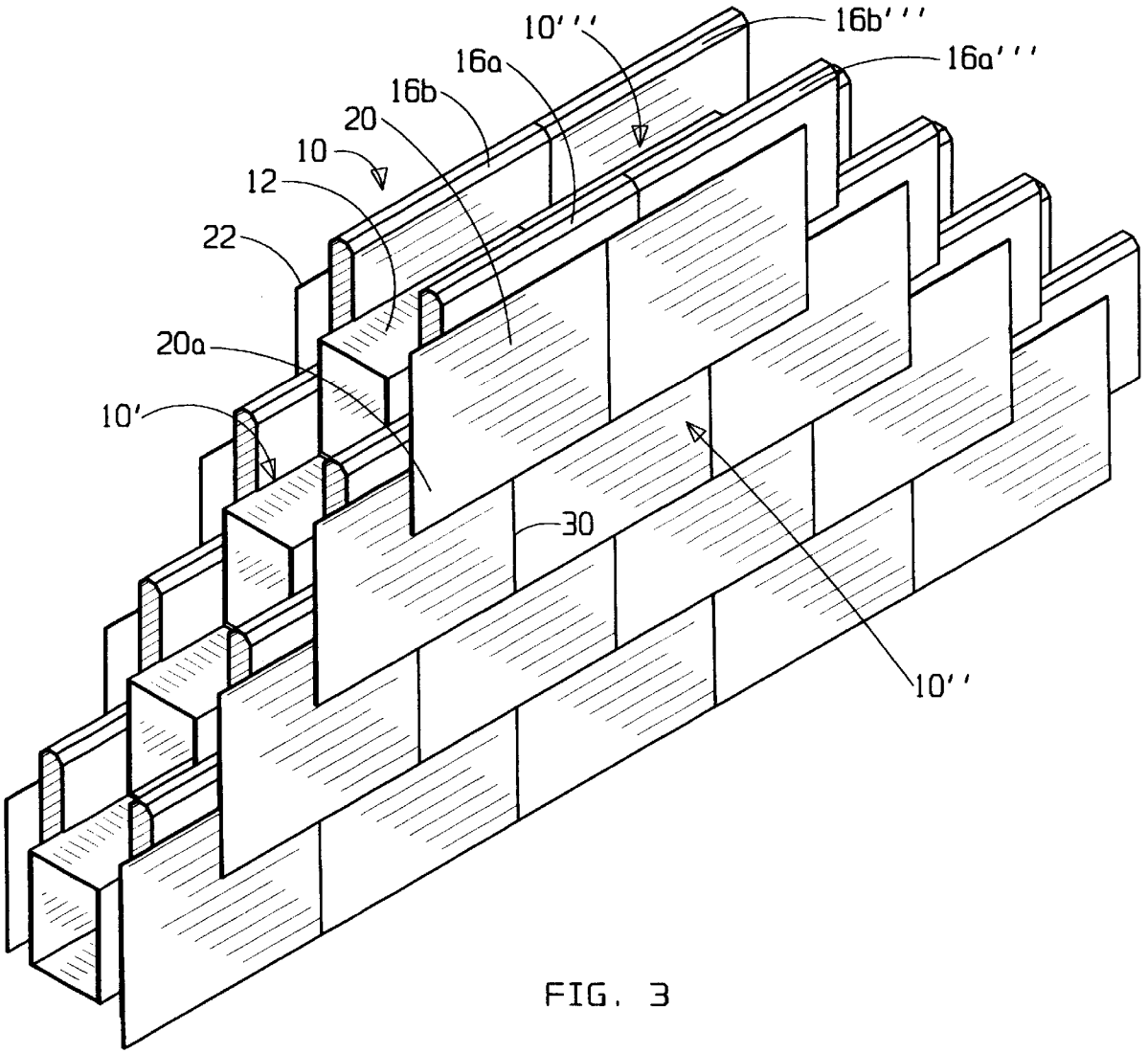
FIG. 3 is, in front perspective view, a partially constructed wall of the building blocks of FIG. 1.
Figure 4:
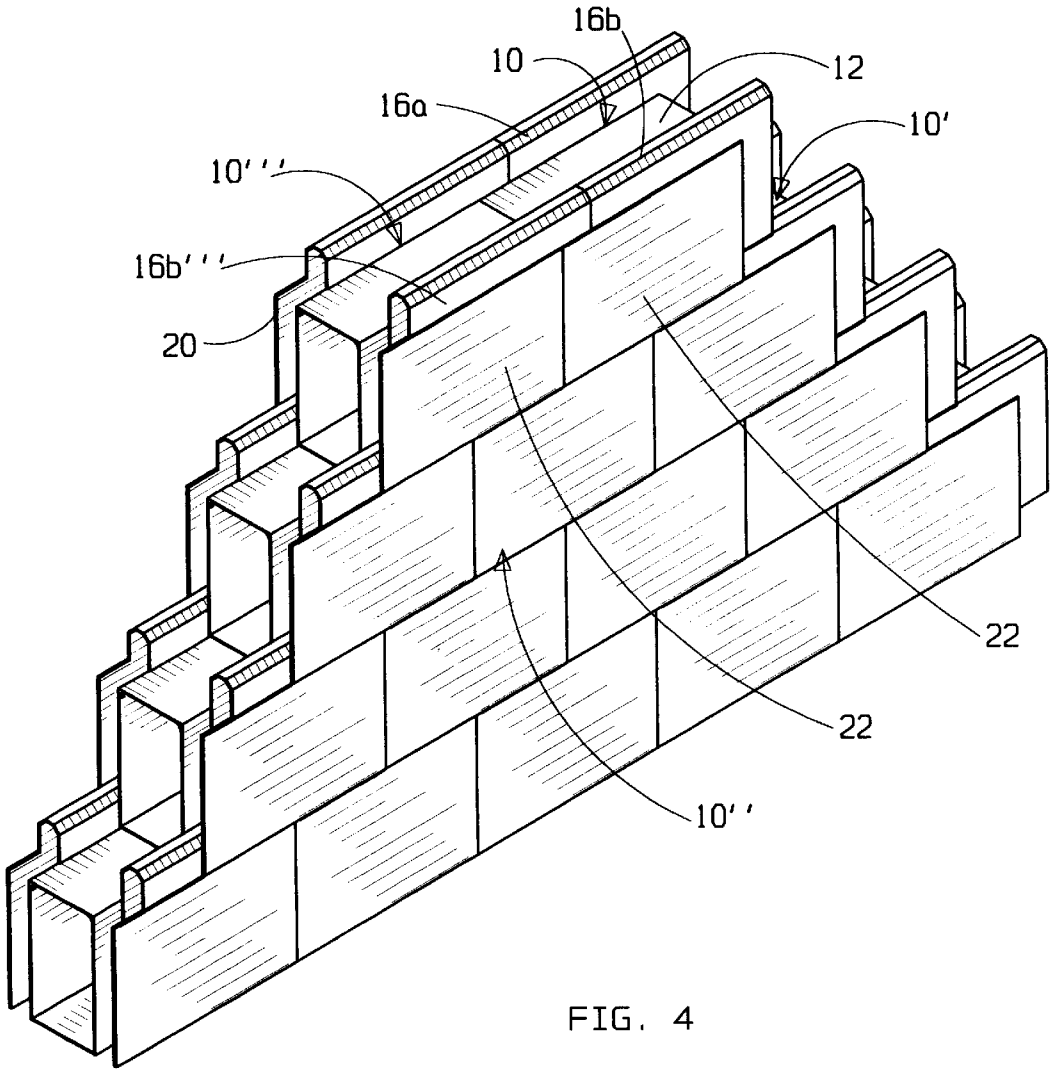
FIG. 4 is, in rear perspective view, the partially constructed wall of FIG. 3.
Figure 5:
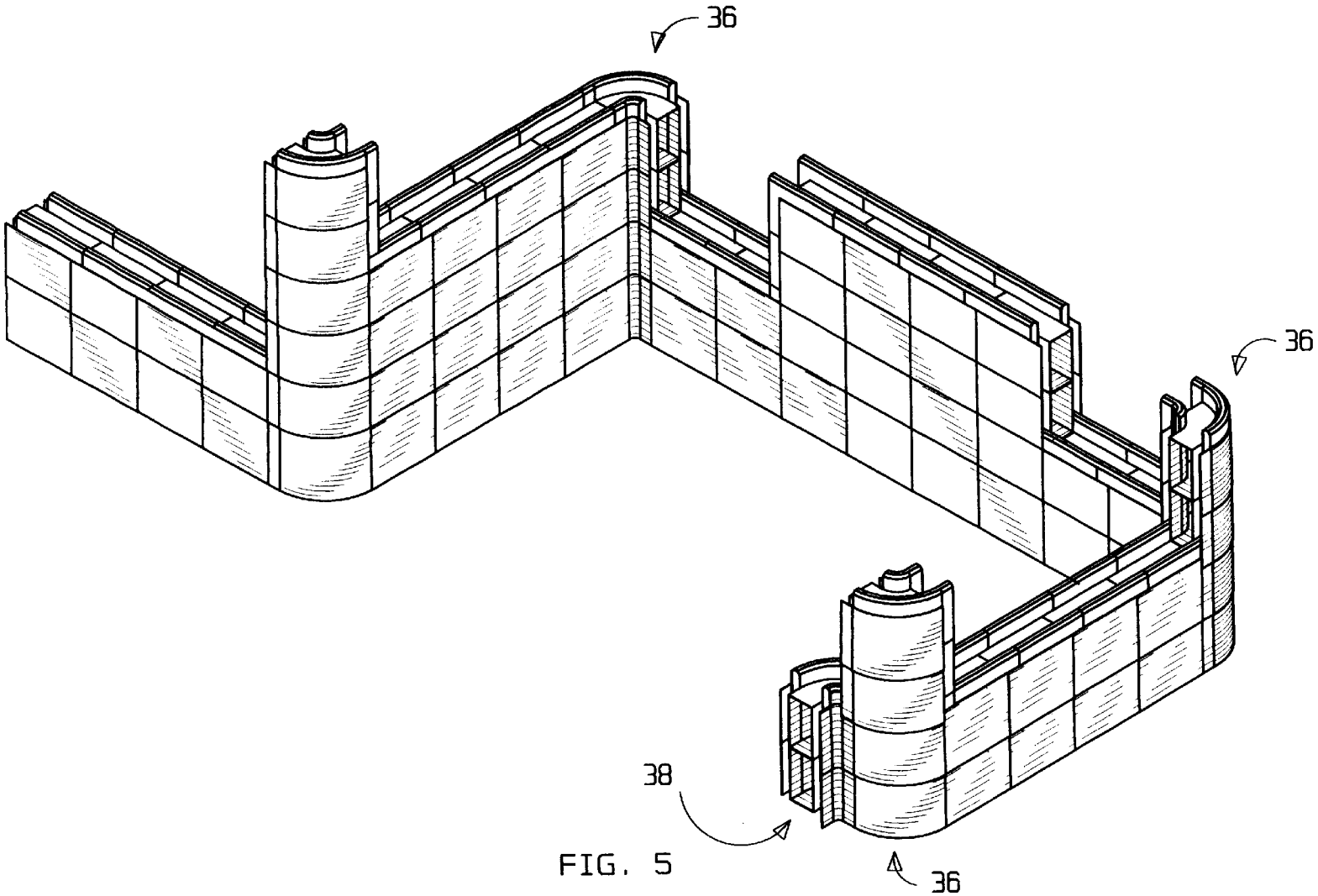
FIG. 5 is, in perspective view, a partially constructed walled habitat using the wall building blocks of FIG. 1 and the corner building blocks of FIGS. 6–9.
Figure 6:
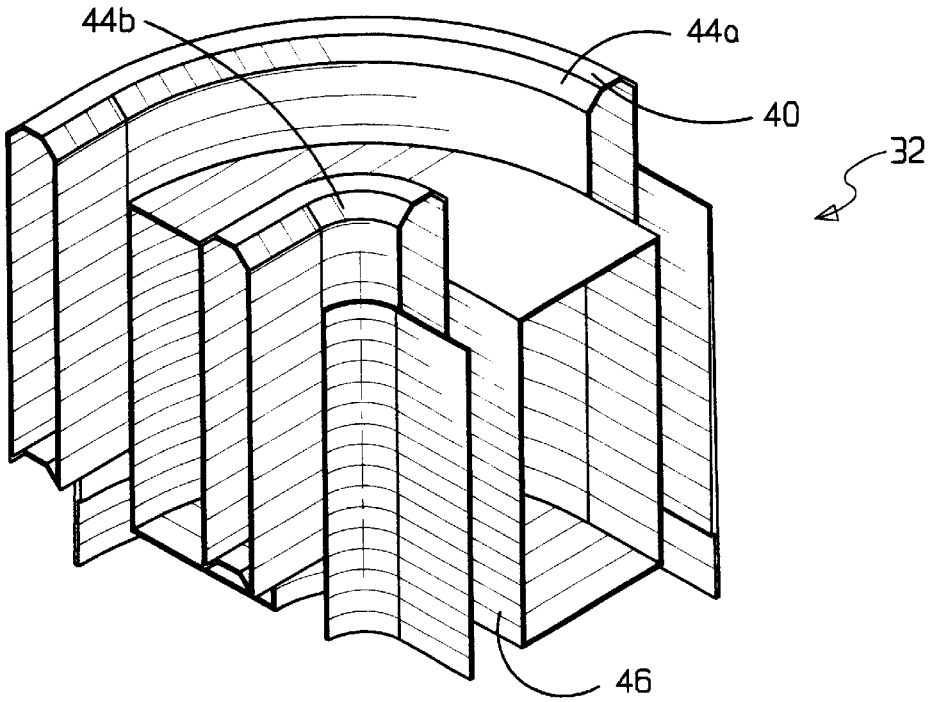
FIG. 6 is, in rear perspective view, an outer corner block of the present invention.
Figure 7:
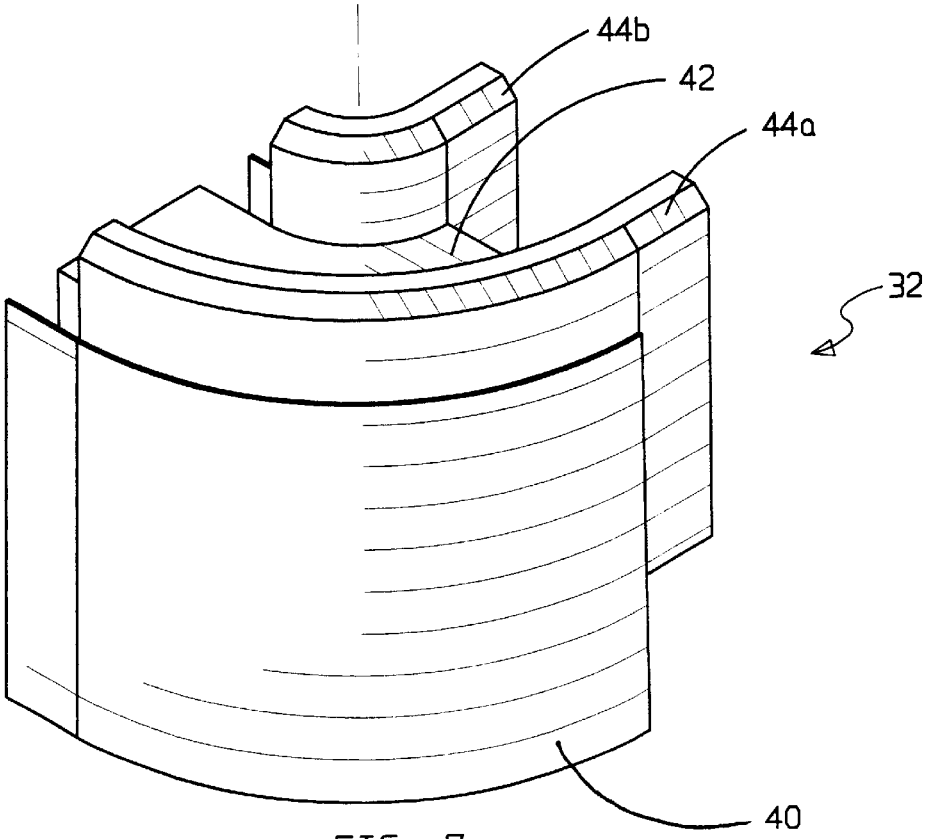
FIG. 7 is, in front perspective view, the outer corner block of FIG. 6.
Figure 8:
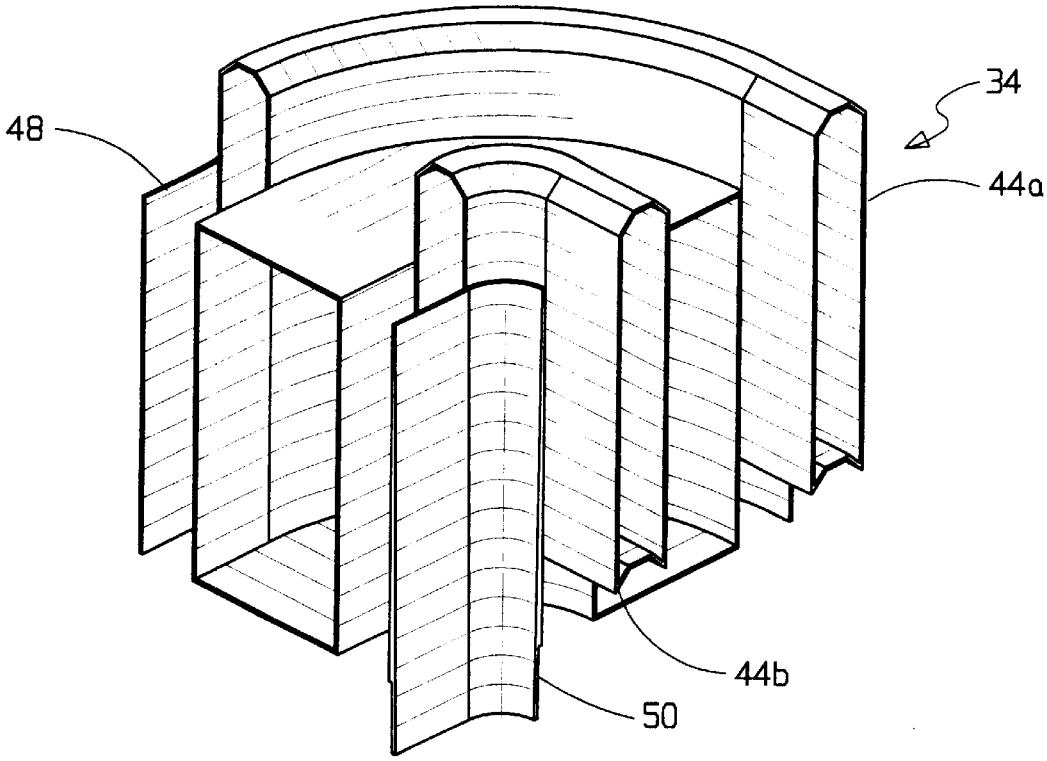
FIG. 8 is, in rear perspective view, an inner corner block of the present invention.
Figure 9:
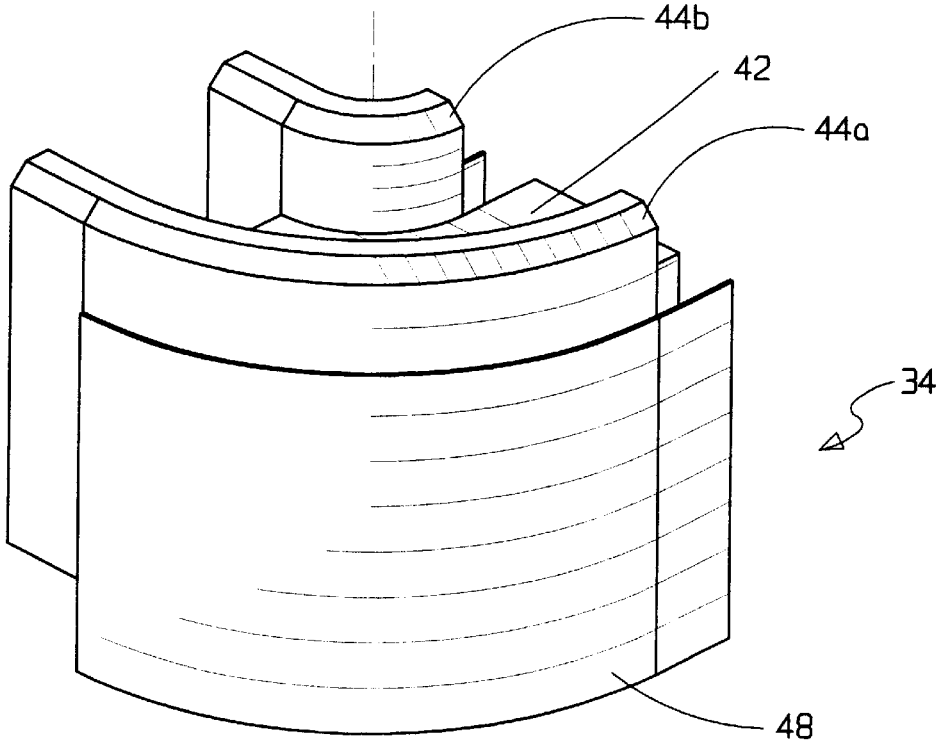
FIG. 9 is, in front perspective view, the inner corner block of FIG. 8.

In lateral cross section, tenon members 16*a* and 16*b* have identically chevron-shaped cross sections defining a vertically projecting ridge 24 which extends along the top edges of tenon members 16*a* and 16*b* parallel to the upper surface 26*a* of block 12. Ridges 24 are triangularly-shaped in lateral cross section for snug mating engagement into v-shaped channels 28 formed longitudinally along the undersides of tenon members 16*a* and 16*b*. Thus ridges 24 mate into the corresponding channels 28 in a next vertically adjacent building block 10 when forming a wall constructed modularly of building blocks 10 such as seen in FIGS. 3 and 4. Channels 28 extend the full length of the tenon members and the vertices 28*a* of channels 28 are parallel to the lower surface 26*b* of block 12.

In constructing a wall of building blocks 10, a first building block 10 is offset longitudinally relative to neighbouring blocks 10' and 10" in the next adjacent row of building blocks below first building block 10, and is similarly offset to a next adjacent row of building blocks 10 in any next adjacent row above. In the row containing first building block 10, first building block 10 is interlocked with the next adjacent blocks by tenon and slot mortise interlocking whereby the projections of tenon members 16*a* and 16*b* interlock with the mortised recesses behind the corresponding tenon members 16*a*'" and 16*b*'" in building block 10'". Similarly, a building block (not shown) on the opposite side of first building block 10, opposite to building block 10'", interlocks its protruding tenon members into the recesses formed behind tenon members 16*a* and 16*b* between block 12 and siding member 20 and facing member 22 respectively. As may be seen, preferably first building block 10 is offset so that the intersection 30 between building blocks 10' and 10" in the row below first building block 10 lie in a plane which generally laterally bisects block 12 along its length.

In the preferred embodiment, siding member 20 extends below the plane containing lower surface 26*b* of block 12 so as to form a downwardly extending cantilevered flange 20*a*. In one embodiment the flange may be gently outwardly flared. In such an embodiment the outer surface of flange 20*a* may be inclined relative to, for example, the plane containing longitudinal side 14*a* of block 12 so as to give the appearance of conventional siding in an assembled wall. Flange 20*a* may be mounted to tenon member 16*a* by means of a base member 20*c*. Similarly, facing member 22 is also rectangular in size similarly to base 20*c*, that is, so as not to project below the plane containing lower surface 26*b* or above the plane containing upper surface 26*a*. Thus in the wall viewed in FIG. 4, facing members 22 abut one another to form a planar interior surface of the habitat, and in the wall as viewed in FIG. 3, siding members 20 abut along their horizontal rows and overlap the next adjacent row below to provide a sealed shedding of rain water and the like.

As better seen in FIGS. 5–9, modified corner blocks may be employed which, based on the same interlocking principles as building blocks 10, allow for formation of inside and outside rounded columnar corners. This introduces a flexibility of construction so that a habitat constructed of building blocks 10 and the modified corner blocks does not necessarily have to merely form a rectangular structure but, rather, maybe more elaborate. Thus, outside corner blocks 32 and inside corner blocks 34 may be vertically mounted one on top of another so as to form a vertical column 36 of outer corner blocks 32 or a vertical column 38 of inner corner blocks 34.

Outer corner blocks 32 have an outer radiussed siding member 40 for abutted mating with the ends of siding members 20 on adjacent building blocks 10 in adjacent orthogonal walls. A radiussed hollow center block 42 sandwiches a radiussed tenon member 44*a* between siding member 40 and center block 42. An inner radiussed internal facing member 46 sandwiches a tenon member 44*b* between facing member 46 and center block 42. Thus as may be seen, other than the radiussing of the elements including the tenon members, the center block, the facing member and the siding member, outer corner block 32 is identical to building block 10 in terms of its interlocking functionality between vertical blocks in column 36 and horizontally adjacent building blocks 10 in adjacent walls.

Similarly, inner corner block 34 has an outer radiussed facing member 48, a radiussed center block 42, and an inner radiussed siding member 50. An outer radiussed tenon member 44*a* is sandwiched between outer radius facing member 48 and center block 42. An inner radiussed tenon member 44*b* is sandwiched between inner radiussed siding member 50 and center block 42. Again, as with outer corner blocks 32, inner corner blocks 34 are substantially identical to building blocks 10 except for the radiussing of the tenon members, the center block, the facing member and the siding member. Otherwise the interlocking functionality remains the same as with building blocks 10 and outer corner blocks 32.

Figure 10:
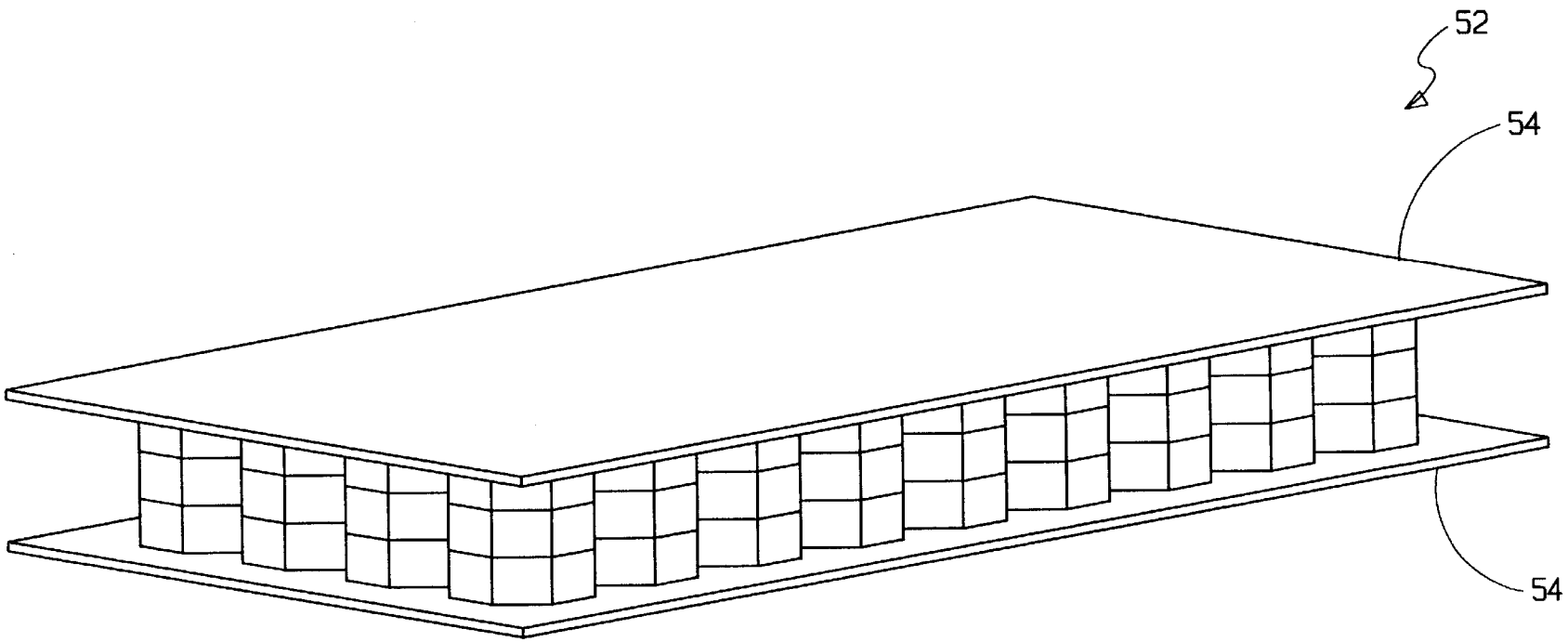
FIG. 10 is, in perspective view, an assembled honeycomb cell sandwich sheet.
Figure 10A:
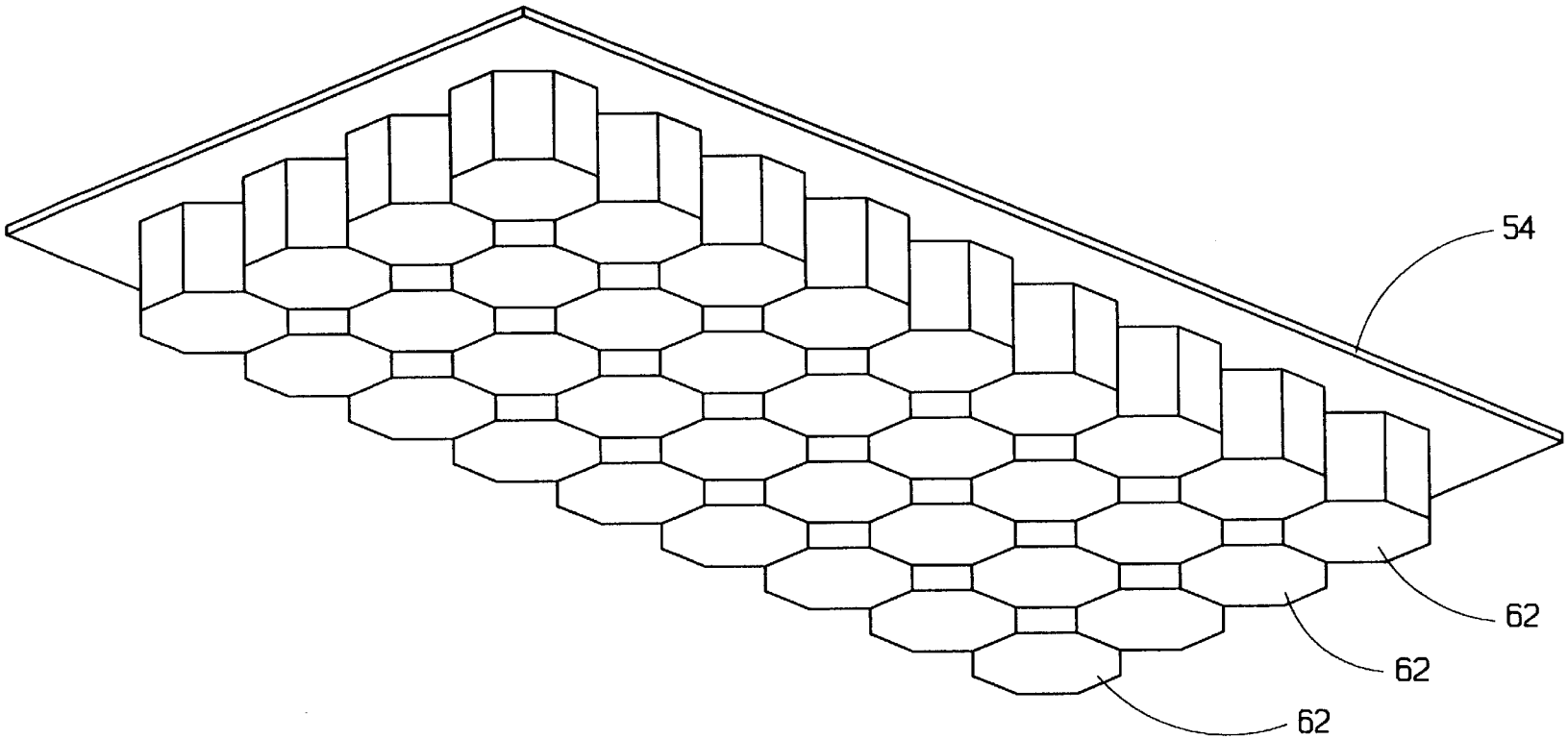
FIG. 10*a* is, in perspective view, one half of the sheet of FIG. 10.
Figure 10B:
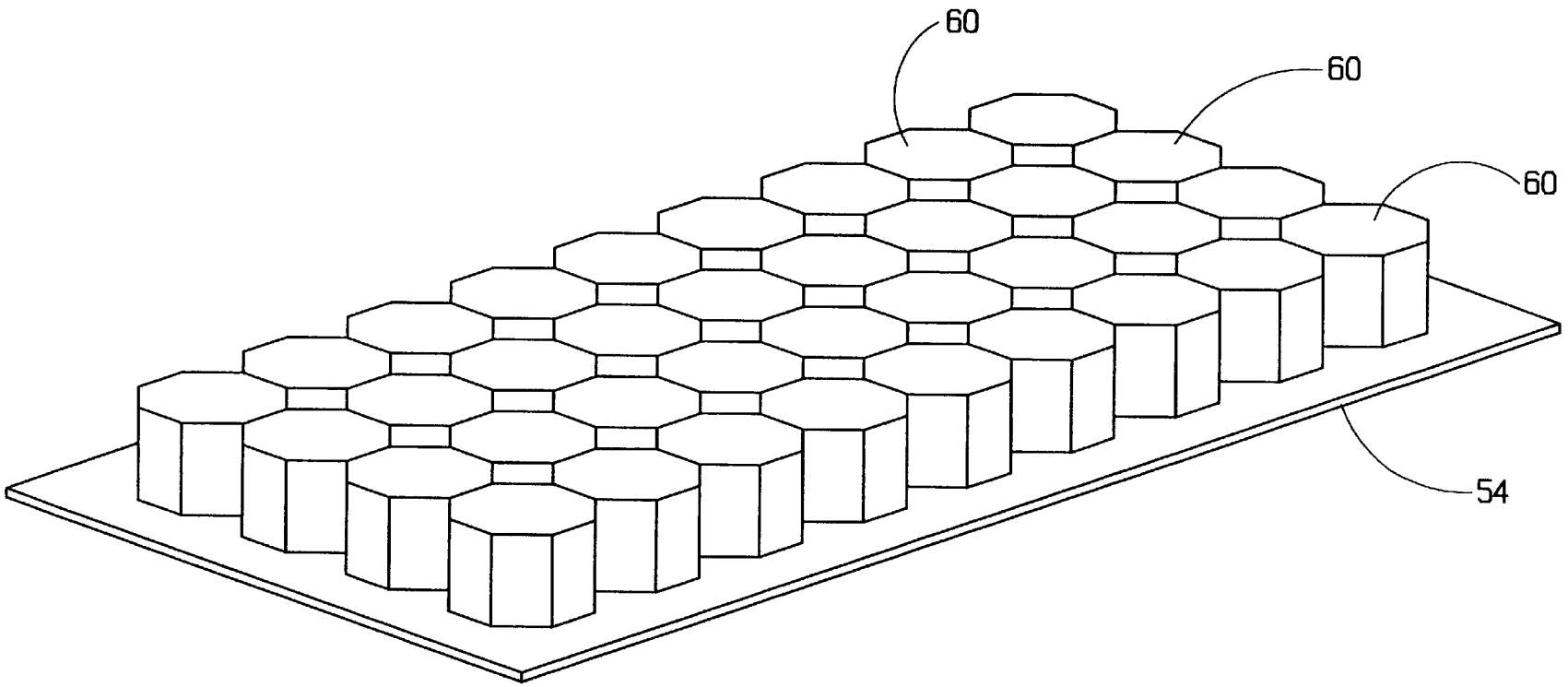
FIG. 10*b* is, in perspective view, the other half of the sheet of FIG. 10.
Figure 14A:
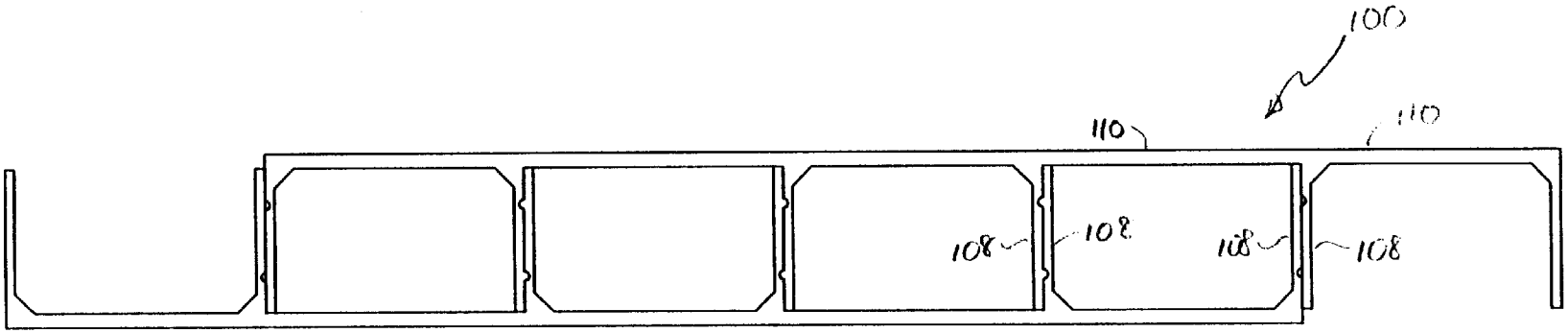
FIG. 14*a* is, in end elevation view, a modular sheet.
Figure 14B:
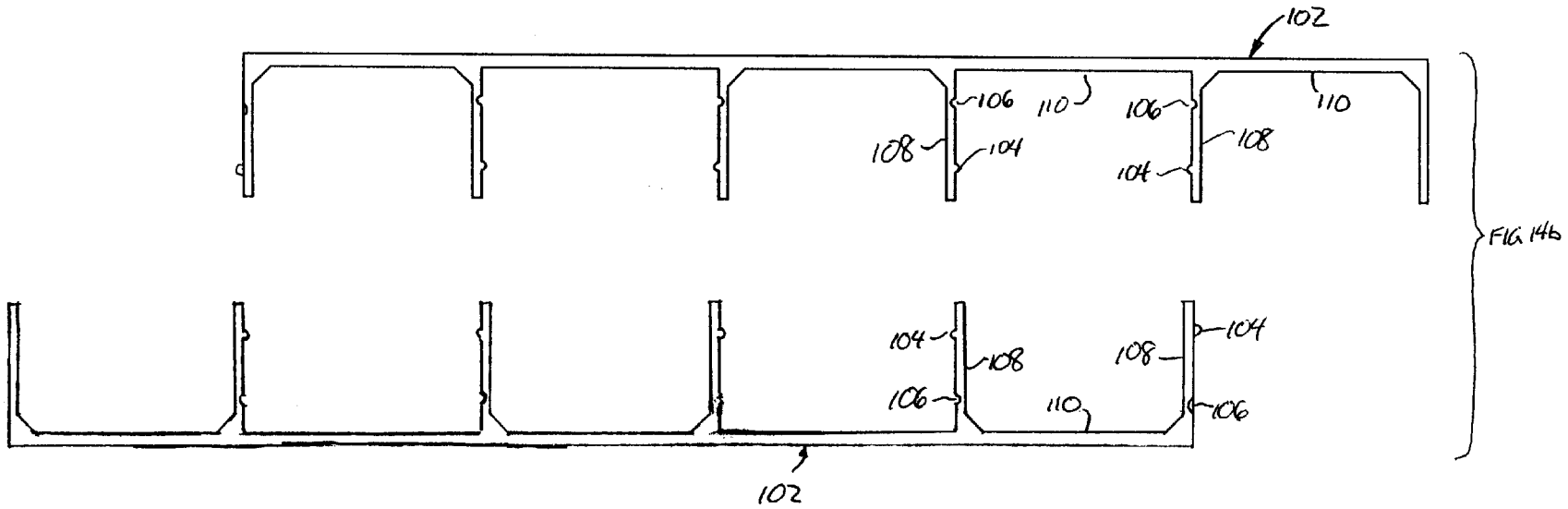
FIG. 14*b* is, in exploded end elevation view, the modular sheet of FIG. 14*a*.
Figure 14C:
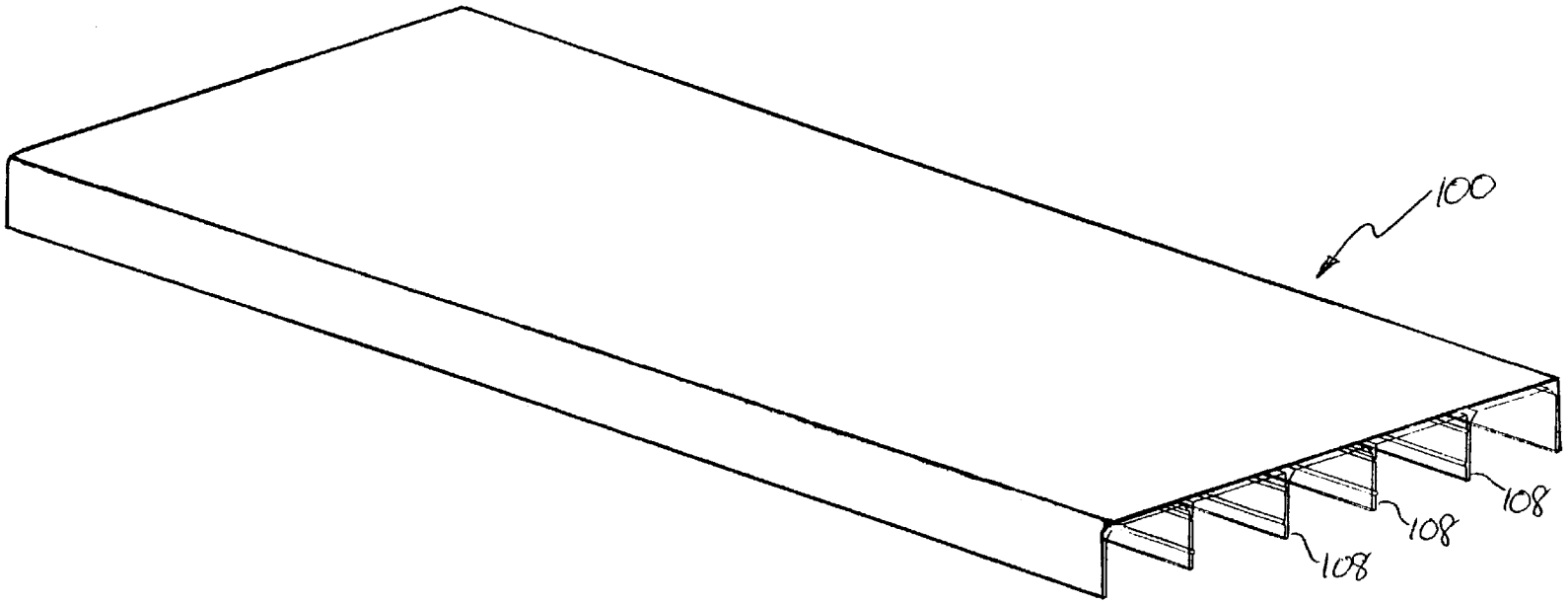
FIG. 14*c* is, in perspective view, the upper half of the modular sheet of FIG. 14*a*.

A sandwiched honeycomb roof structure as seen in FIG. 10 may be provided as a lightweight modular roofing which may be used to fabricate a roof onto a habitat made according to the present invention. The sandwiched honeycomb cell sheet 52 has parallel spaced apart planar members 54 sandwiching therebetween upper and lower arrays 56 and 58 respectively of nested honeycomb cells 60 and 62 respectively, better seen in FIGS. 10*a* and 10*b*. Alternatively, as seen in FIGS. 14*a*–14*c*, the modular roofing may be constructed of sheeting or panels 100 comprised of interlocking T-sheets 102 which mate one to the other in opposed facing relation by snapping pins 104 into mating recesses 106 in legs 108 cantilevered from base sheets 110. The resulting panels 100 are formed of an adjacent array of parallel beams.

The center blocks, including blocks 12 and 42, may have frangible walls so that, for example, if it is wished to run a vertical conduit upwardly through a wall constructed of blocks 10, 32 or 34, the frangible upper and lower walls of the center blocks are broken through so as to allow journalling of the conduit upwardly through the blocks vertically aligned in mounted array. Alternatively, pre-formed apertures may be provided in the walls of the block for passage of conduit therethrough, or for pouring concrete therethrough in the manner of a columnar concrete form.

Thus as may be seen, employing the modular tenon and slot mortise building blocks of the present invention, external walls of habitable structures may be constructed without the need for special tools, binders or skilled artisans. The construction is a one step assembly which results in an insulated wall having exterior sidings and an interior finished surface using modular components which resemble lightweight bricks. Being lightweight further eases calculations of any required foundation. Further, the components are reusable and, due to their interlocking commonality, additions to existing structures or redesign of existing structures may be accomplished with relative ease.

As will be appreciated, use of the building blocks of the present invention reduces the environmental impact such as encountered with traditional building methods. It will also be appreciated that the repetitive modularity of assembly results in simplicity of both assembly and un-assembly without special tooling to allow for re-using of the blocks. Further, the use of hollow structures not only reduces weight and provides for insulation space, but also provides air tunnels for service structures such as water piping and wiring. As will be understood to one skilled in the art, the external and internal facing of each block may be adapted to allow traditional finishing of the surfaces if required. The building blocks of the present invention may also be used to construct non-weight bearing walls for column and beam structures. As will also be understood to one skilled in the art, walls constructed according to the present invention are readily adaptable to accept the available different roofing systems. Further, walls constructed according to the present invention may be adapted to interact with most conventional hardware, doors and window systems presently available.

Figure 11:
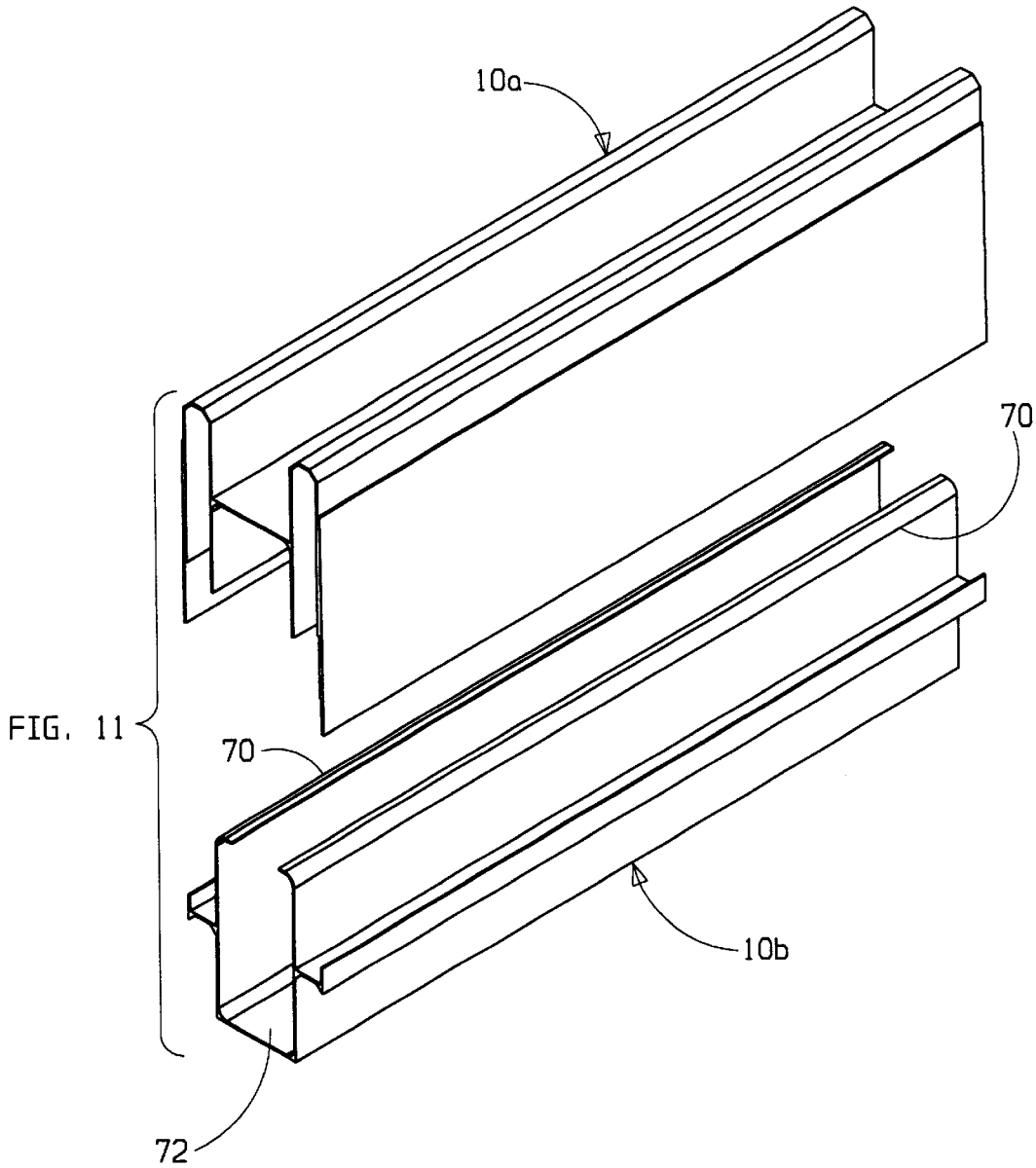
FIG. 11 is, in exploded perspective view, an alternative embodiment of the present invention.
Figure 12:
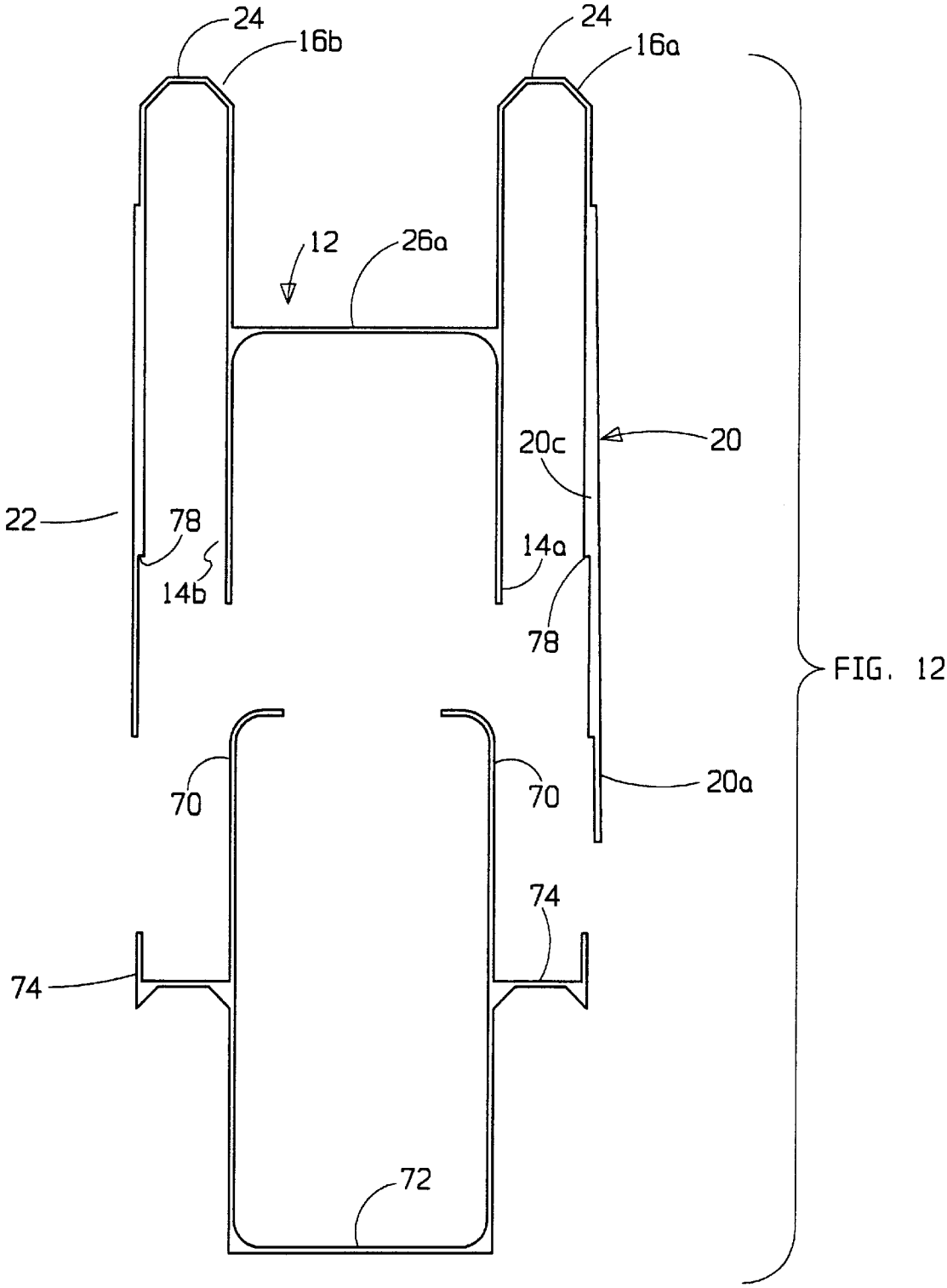
FIG. 12 is, in exploded end view, the alternative embodiment of FIG. 11.
Figure 13:
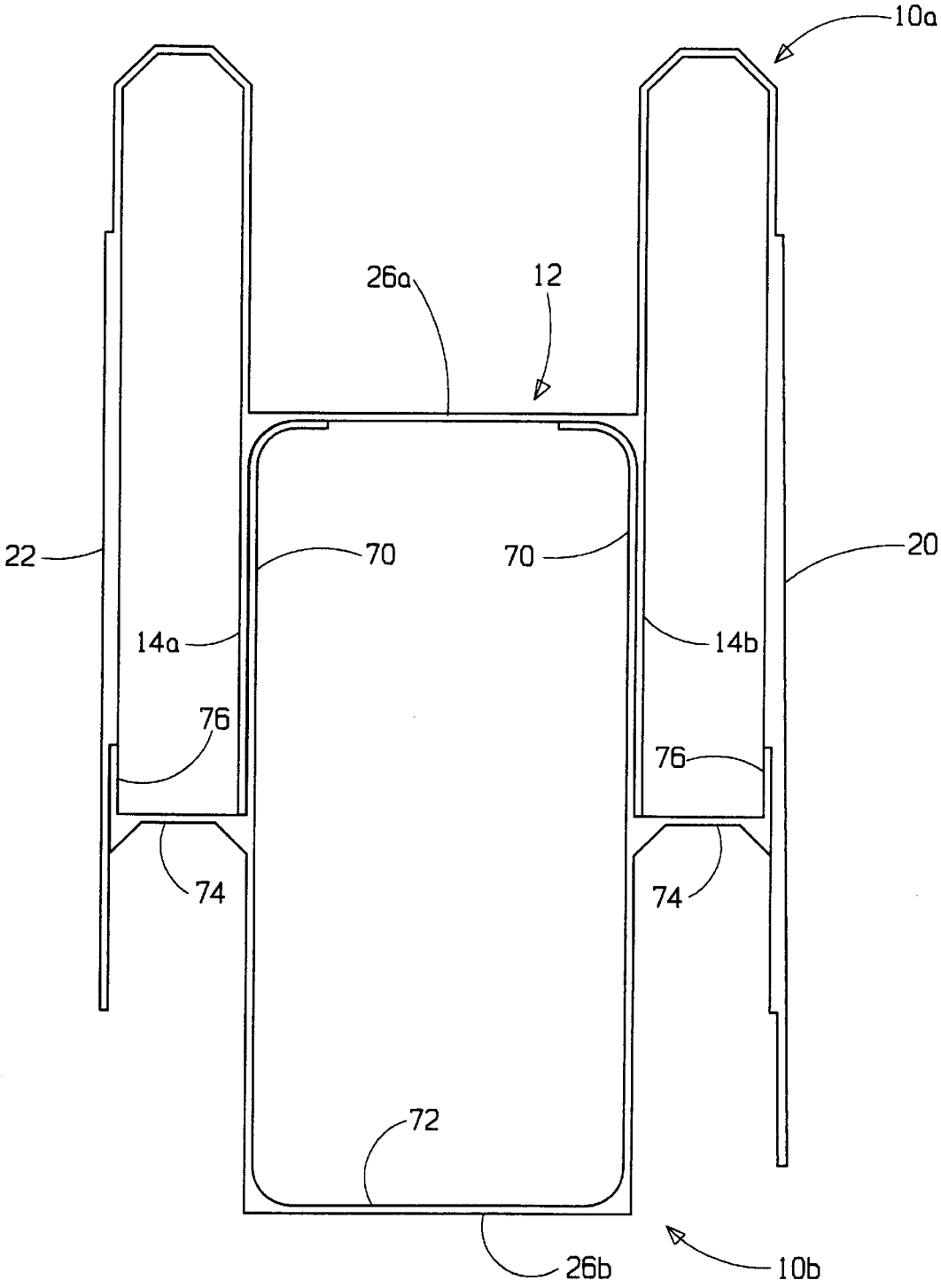
FIG. 13 is, in end view, the alternative embodiment of FIG. 12 with the upper and lower members mated together.

In the above example of a building block according to the present invention, such a block may for example be manufactured by an injection molding process. However, it is often more cost effective to manufacture using an extrusion process. An example of how a building block may be manufactured using an extrusion process is the subject of FIGS. 11–13. As may be seen in FIG. 11, a single building block of any suitable length, may be constructed of interlocking upper and lower members 10*a* and 10*b*. The upper member 10*a* fits over the lower member 10*b* so as to snugly friction fit upper flanges 70 into the cavity defined by upper surface 26*a* and sides 14*a* and 14*b*. Flanges 70 form the upper extremities of a U-shaped channel 72 which extends beneath sidewalls 14*a* and 14*b* so that the bottom of the channel defines lower surface 26*b*. Auxiliary channels 74 extend cantilevered outwardly on oppositely disposed sides of channel 72. Auxiliary channels 74 extend the length of channel 72 parallel to the upper edges of flanges 70. Auxiliary channels 74 are vertically spaced from the upper edges of flanges 70 so that when flanges 70 are snugly seated between sides 14*a* and 14*b* and against upper surface 26*a*, auxiliary channels 74 snug up against the lowermost edges of sides 14*a* and 14*b* and lips 76 of auxiliary channel 74 snugly mate into corresponding notches 78 on the interior sides of siding 20 and facing 22.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A modular tenon and slot mortise building block for the modular construction of habitable shelters comprising:

(a) a hollow rectangular parallelepiped center block, (b) an outer siding member, (c) a first tenon member sandwiched between said center block and said siding member, (d) an inner facing member, and (e) a second tenon member sandwiched between said center block and said facing member, wherein said tenon members are parallel and mounted to longitudinal sides of said center block, and wherein said tenon members are each, in lateral cross-section, generally chevron-shaped so as to form:

(a) a ridge along the upper surface of said tenon members having a generally triangle-shape in lateral cross-section, and (b) a channel along the lower surface of said tenon members having said generally triangle-shape in lateral cross-section, and wherein said siding member has a lower generally planar skirt which extends cantilevered downwardly from a base of said siding member mounted adjacent said first tenon member.

2. The block of claim 1 wherein said tenon members are positioned and of a length so as to extend longitudinally of a first end of said center block by a first distance and so as to form mortised first and second recesses having a first depth behind said first and second tenon members, respectively, between said siding member and said center block and between said facing member and said center block, wherein said first distance is substantially equal to said first depth.

3. The block of claim 1 wherein said skirt is also cantilevered outwardly by flaring of said skirt along a lower end of said skirt.

4. The block of claim 1 wherein a first plane containing a lowermost surface of said center block also contains a lowermost edge of said facing member, and a second plane, parallel to said first plane, containing an uppermost surface of said center block also contains uppermost edges of said facing member and said siding member.

5. The block of claim 1 wherein said siding and facing members have oppositely disposed rectangular planar exposed surfaces.

6. The block of claim 1 wherein said building block is radiussed around a corner so as to form a corner block, and wherein said siding member is radially outermost relative to said corner and said facing member is radially innermost so as to form an outer corner block.

7. The block of claim 1 wherein said block is radiussed around a corner so as to form a corner block, and wherein said facing member is radially outermost relative to said corner and said siding member is radially innermost so as to form an inner corner block.

8. The block of claim 1 wherein said center block has frangible upper and lower walls whereby said frangible walls may be selectively broken through for passage of conduit through stacked rows, or through columns of said building blocks.

* * * * *